United States Patent [19]

Hills et al.

[11] Patent Number: 4,563,159

[45] Date of Patent: Jan. 7, 1986

[54] TOY CONVERTIBLE AMONG MULTIPLE CONFIGURATIONS

[75] Inventors: Kenneth B. Hills, Roslyn Heights; Vlasta Cihlar, Jackson Heights, both of N.Y.

[73] Assignee: Animal Toy Imports, Inc., Brooklyn, N.Y.

[21] Appl. No.: 693,376

[22] Filed: Jan. 22, 1985

[51] Int. Cl.[4] ..... A63H 3/00

[52] U.S. Cl. ..... 446/74; 446/369

[58] Field of Search ..... 446/74, 73, 72, 76, 446/369, 268, 75; 150/103, 106

[56] References Cited

U.S. PATENT DOCUMENTS

| | | | |
|---|---|---|---|
| 1,583,284 | 5/1926 | Dykman | 446/74 |
| 1,630,844 | 5/1927 | Hall | 446/74 X |
| 2,591,379 | 4/1952 | Schradermeier | 446/74 X |
| 4,413,442 | 11/1983 | McSweeney | 446/73 |

*Primary Examiner*—Mickey Yu

*Attorney, Agent, or Firm*—Kirschstein, Kirschstein, Ottinger & Israel

[57] ABSTRACT

A toy having multiple configurations convertible among a stuffed figurine, a stuffed tote bag with the figurine entirely contained and concealed therein, and a combination figurine-tote bag with a part of the figurine located exteriorly of the tote bag.

1 Claim, 7 Drawing Figures

FIG. 1
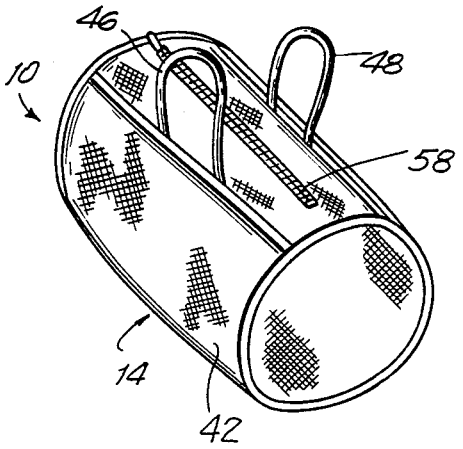
FIG. 2
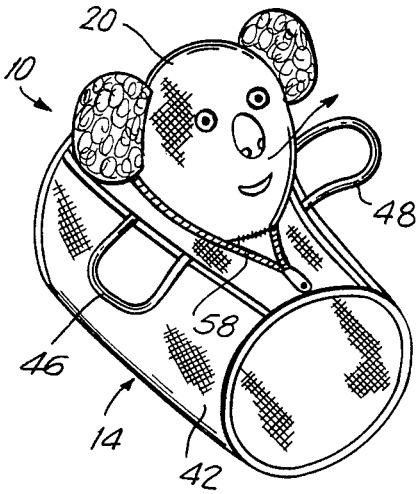
FIG. 3
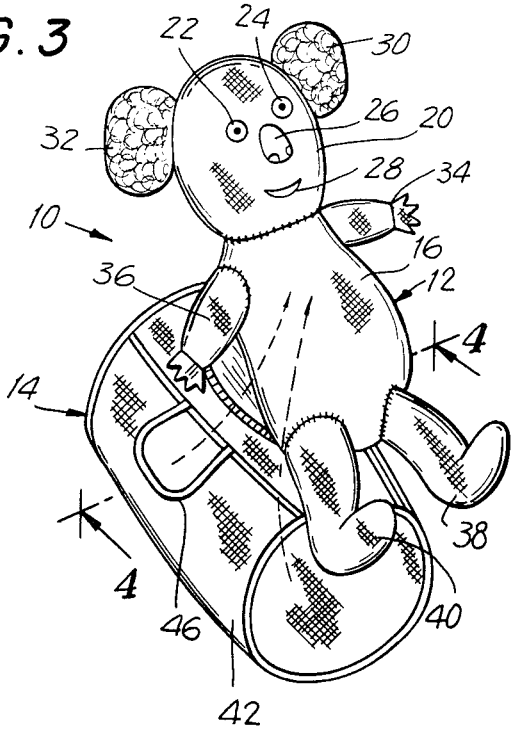
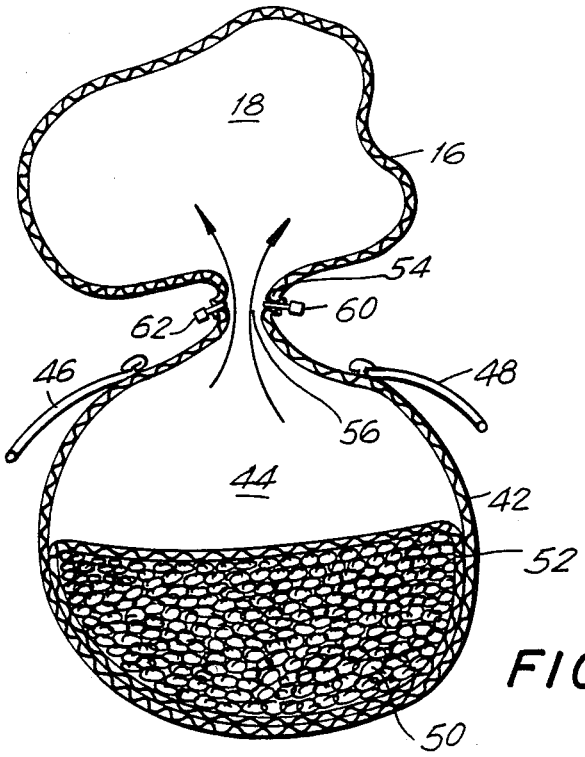
FIG. 4

FIG. 5
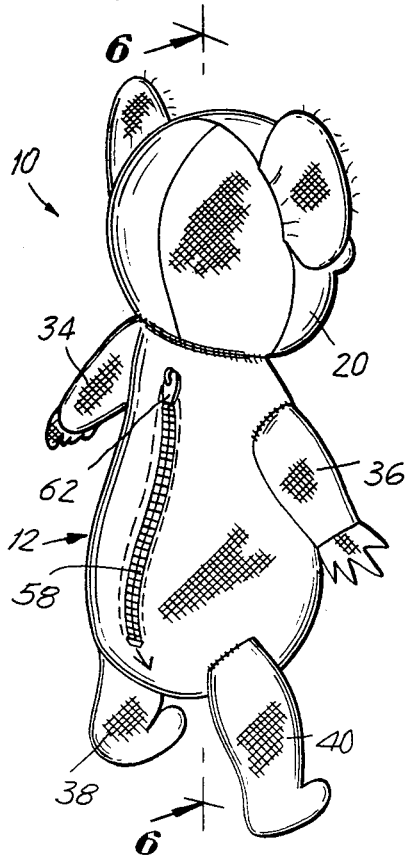
FIG. 6
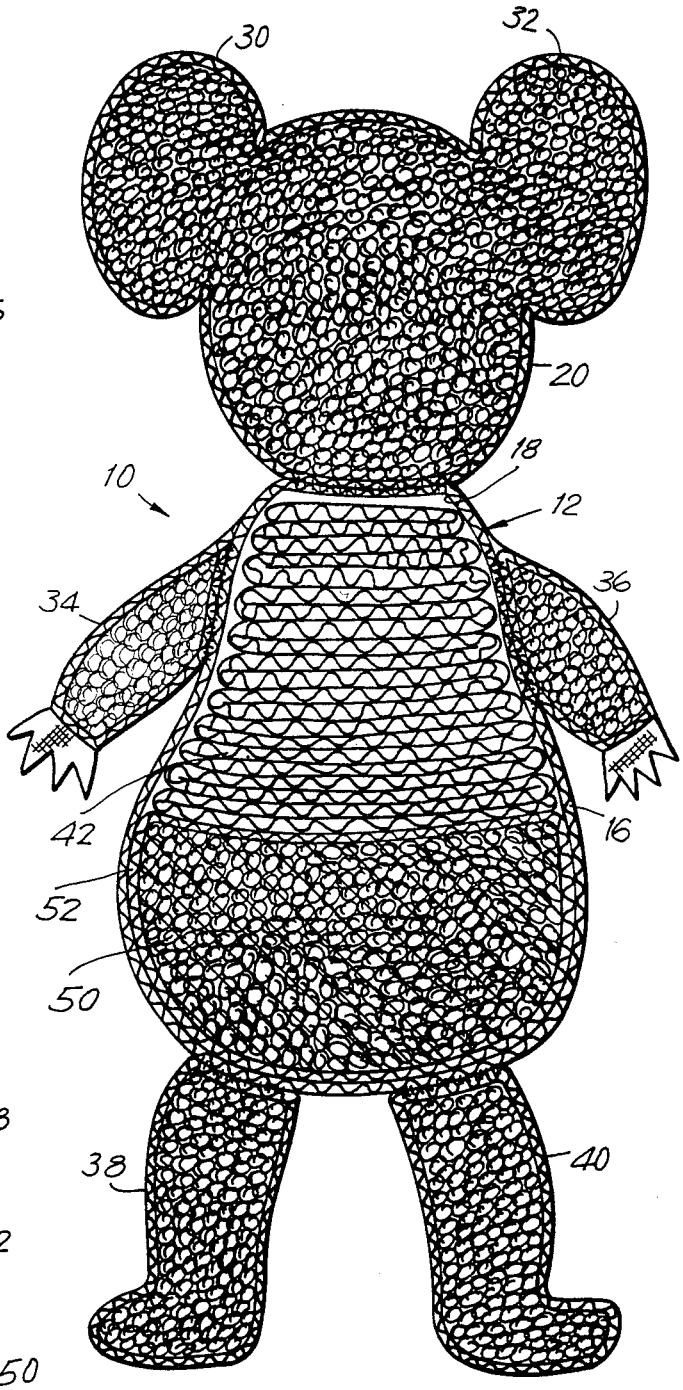
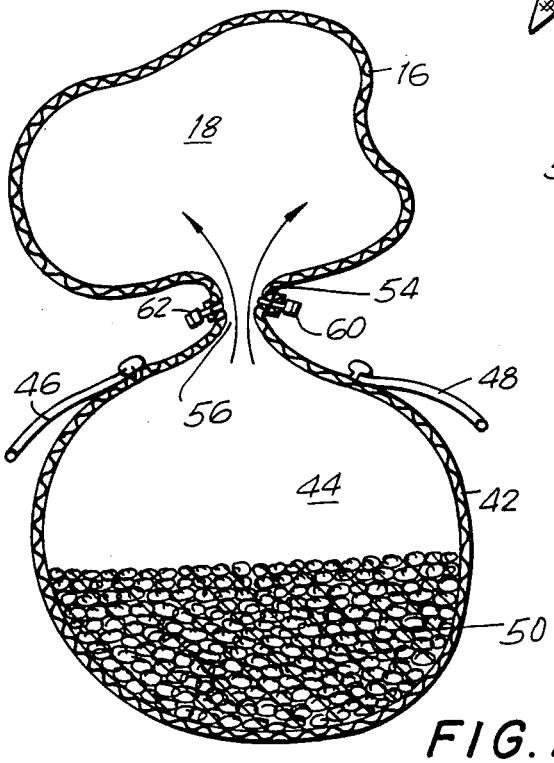
FIG. 7

TOY CONVERTIBLE AMONG MULTIPLE CONFIGURATIONS

BACKGROUND OF THE INVENTION

1. Field of the Invention

This invention generally relates to a toy convertible among multiple configurations and, more particularly, to a toy whose overall configuration can be quickly and easily changed among a stuffed figurine, a stuffed tote bag with the figurine entirely contained and concealed therein, and a combination figurine-tote bag with a part of the figurine located exteriorly of the tote bag.

2. Description of the Prior Art

The play value of a toy is enhanced when it enables a child to simulate adult behavior in some real-life activity. Thus, for example, it happens, from time to time, in family life that a parent will take a family pet in a carrying case to the veterinarian for treatment, care or monitoring. Sometimes, the family pet is taken to a kennel in the carrying case. It also happens that, when the family travels by plane, train or boat, or sometimes by car, particularly on extended trips, the family pet is taken along in the carrying case.

A child seeing these real-life activities often would like to participate, and act out the adult role, by taking his or her "pet" along in a carrying case. Typically, such a "pet" is a stuffed animal toy which is very popular with children, and which often is played with all day long, carried from place to place by the child, and usually taken to bed. However, the child cannot simulate any of the aforementioned activities too closely because, as a general rule, he or she has no carrying case in which to transport the stuffed animal pet, or, if he or she has a carrying case, it generally is not readily at hand.

SUMMARY OF THE INVENTION

1. Objects of the Invention

It is a general object of this invention to increase the play value and entertainment reward of stuffed animal toys by incorporating therein a carrying case useful for carrying the stuffed animal toy in a realistic simulation of such adult activities as taking the family pet to the veterinarian or kennel, or along on extended trips, or the like.

Another object of this invention is to enable one, particularly a child, to easily and quickly change the overall shape of a toy among a stuffed figurine, a stuffed tote bag with the figurine entirely contained and concealed therein, and a combination figurine-tote bag with a part of the figurine located exteriorly of the tote bag.

An additional object of this invention is to provide a toy with multiple configurations which is fun to play with, can occupy a child for long periods of time, stimulates the child's imagination, is durable in construction, is safe to use, and is inexpensive to manufacture.

2. Features of the Invention

In keeping with these objects, one feature of the invention resides, briefly stated, in a toy convertible from one stuffed toy figurine to another. The toy comprises a figurine portion and a bag portion integrally connected together. The figurine portion has a hollow figurine part, e.g. a hollow torso part, bounding an interior figurine cavity. The bag portion has a hollow container part bounding an interior bag cavity. The figurine and bag portions are connected on a common wall bounding a common opening which communicates with both the interior figurine and bag cavities.

The figurine portion is foldable and collapsible to a compact state, and is at least partially stuffable in its compact state in one direction through the common opening into the interior bag cavity to stuff the same and convert the toy to a stuffed bag wherein the figurine portion is entirely contained and concealed therein.

In another stuffed toy configuration of this invention, the bag portion is foldable and collapsible to a compact state, and is stuffable in its compact state in a direction opposite to said one direction through the common opening into the interior figurine cavity to stuff the same and convert the toy to a stuffed figurine wherein the bag portion is entirely contained and concealed therein.

The common opening is at least partially closed after one of the figurine and bag portions has been stuffed into a respective one of the bag and figurine cavities by a closure means which, in a preferred embodiment, is a double-pull zipper.

In an advantageous construction, the figurine portion has a head part, a pair of arm parts, and a pair of leg parts, each having a hollow interior which is pre-stuffed with a stuffing material, and which is connected to the aforementioned hollow torso part. Rather than inserting the entire figurine portion into the bag cavity, still another configuration of this toy can be achieved by inserting a part of the figurine portion into the bag cavity. Thus, for example, the torso, arm and leg parts may be stuffed into the bag cavity while leaving the head part exposed. This configuration enables the child to carry his pet from place to place.

Thus, the toy is easily converted among a tote bag configuration, a figurine configuration, and a combination figurine-tote bag configuration, even by an unskilled person, for example, a child, to increase the overall play value and entertainment reward of the toy.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 1 is a front perspective view of a toy in accordance with the invention in a first stuffed tote bag configuration with a figurine totally contained and concealed therein;

FIG. 2 is a front perspective view of the toy in accordance with the invention in a second combination figurine-tote bag configuration with the head part of the figurine located exteriorly of the tote bag;

FIG. 3 is a front perspective view of the toy in accordance with the invention in a transitional stage of changing the overall shape of the toy from the second configuration;

FIG. 4 is an enlarged sectional view taken on line 4—4 of FIG. 3;

FIG. 5 is a rear perspective view of the toy in accordance with the invention in a third stuffed figurine configuration with the tote bag totally contained and concealed therein;

FIG. 6 is an enlarged sectional view taken on line 6—6 of FIG. 5; and FIG. 7 is a view analogous to FIG. 4 of a modification of the invention.

DETAILED DESCRIPTION OF THE PREFERRED EMBODIMENTS

Referring now to the drawings, reference numeral 10 generally identifies a toy convertible among multiple configurations. As best shown in FIGS. 3 and 4, the toy 10 comprises a figurine portion 12 integrally connected, preferably by sewing, in a one-piece construction to a bag portion 14. As described below, in a first configuration, as shown in FIG. 1, the overall shape of the toy 10 is that of a stuffed tote bag in which the figurine portion 12 is entirely contained and concealed. In a second configuration, as shown in FIG. 2, the overall shape of the toy 10 is that of a stuffed combination figurine-tote bag in which a part of the figurine portion 12, e.g. a head part 20, is located exteriorly of the tote bag. In a third configuration, as shown in FIG. 5, the overall shape of the toy 10 is that of a stuffed figurine in which the bag portion 14 is entirely contained and concealed.

The figurine portion 12 includes a hollow torso part 16 bounding an interior figurine cavity 18. The head part 20 is mounted on, and connected to, the torso part 16. The head part 20 has a pair of eye parts 22, 24; a nose part 26; a mouth part 28,and a pair of ear parts 30, 32. A pair of arm parts 34, 36 are mounted on, and connected to, the torso part 16 at opposite lateral sides thereof. A pair of leg parts 38, 40 are mounted on, and connected to, the torso part 16 at the bottom thereof. The figurine portion 12 is shown as being shaped to resemble a bear, although it will be expressly understood that the figurine could have been shaped to resemble any animal, person, cartoon character, extraterrestrial character, robot, humanoid, or object.

The head, arm and leg parts are discrete hollow members, each of which is pre-stuffed with a stuffing material before being connected to the torso part. The stuffing material may be any of the various stuffing materials used for stuffed toys, such as beans, foam, pellets, cotton, crushed walnut shells, plush, etc. The head, arm, leg and torso parts advantageously cover the stuffing material with a soft fabric material. The head, arm and leg parts are sewn by stitching to the torso part.

The bag portion 14 has a hollow container part 42 bounding an interior bag cavity 44, and a pair of carrying handle parts 46, 48, thereby to resemble a tote bag. The container part is advantageously pre-stuffed with a stuffing material 50 of the type described above, and is constituted of a soft fabric material. In the embodiment of FIG. 4, the stuffing material 50 is confinedly received in a pouch 52 which is sewn into the interior bag cavity 44. In the embodiment of FIG. 7, the stuffing material 50 is unconfinedly or loosely received within the interior bag cavity 44.

As best shown in FIG. 4, the figurine portion 12 is sewn to the bag portion 14 on a common wall 54 bounding a common opening 56 which communicates with both the figurine cavity 18 and the bag cavity 44. Starting with the transitional configuration shown in FIG. 3, wherein both the figurine portion 12 and the bag portion 14 are fully exposed and assume their respective erect, unfolded, unfurled orientations, the bag portion 14 may be folded upon itself and collapsed to a compact state such that the bag portion 14 may be stuffed in the direction indicated by the arrows through the common opening 56 into the figurine cavity 18 to stuff the same and convert the toy to a stuffed figurine as shown in FIG. 5.

A zipper 58 having a first pull 60 on one side and a second pull 62 on the opposite side is mounted on the common wall 54, and is operative for opening and closing the opening 56. When the zipper 58 is opened by pulling down either pull 60 or 62, then the compact bag portion 14 may be stuffed through the opening 56, and thereupon, the zipper 58 is closed by pulling up either pull 60 or 62.

As shown in FIG. 5, the resulting configuration looks solely like a stuffed figurine. The bag portion 14 itself constitutes the stuffing for the hollow torso part 16. This best is shown in FIG. 6.

Starting again with the transitional configuration of FIG. 3, the figurine portion 12 may be folded upon itself and collapsed to a compact state such that the entire figurine portion 12 may be stuffed in the opposite direction to that of the arrows through the common opening 56 into the bag cavity 44 to stuff the same and convert the toy to a stuffed tote bag as shown in FIG. 1. Again, the zipper 58 may be closed after the figurine portion 12 has been received entirely within the container part 42. The figurine portion 12 itself constitutes the stuffing for the tote bag.

Rather than inserting the entire figurine portion 12 into the container part 42, it is also within the spirit of this invention to insert a part of the figurine portion. Thus, for example, FIG. 2 shows the resulting configuration when the torso, arm and leg parts have been stuffed into the bag cavity 44, while leaving the head part 20 exposed. This is a particularly attractive carrying position for the child to carry his pet. In addition to the head part 20 being exposed, another modification would be to locate the arm parts and the upper portion of the torso part exteriorly with the head part. The zipper 58 in FIG. 2 can be partially closed to retain those portions of the figurine stuffed in the container part in place.

It will be understood that each of the elements described above, or two or more together, may also find a useful application in other types of constructions differing from the types described above.

While the invention has been illustrated and described as embodied in a toy convertible among multiple configurations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A toy for simulating the transport of a pet in a carrier in one of multiple stuffed toy configurations, comprising:

a figurine portion having a hollow torso part bounding an interior figurine cavity, a head part mounted on the torso part, a pair of arm parts mounted on opposite lateral sides of the torso part, and a pair of leg parts mounted on the torso part, each of said head, arm and leg parts having an interior space stuffed with a stuffing material;

a bag portion having a hollow container part bounding an interior bag cavity, and a pair of carrying handle parts connected to the container part;

means for sewing the figurine portion to the bag portion on a common wall bounding a common opening which communicates with both the interior figurine and bag cavities;

said torso, arm and leg parts of the figurine portion being foldable and collapsible to a first compact state, and being stuffable in the first compact state in one direction through the common opening into the interior bag cavity to stuff the same and convert the toy to a combination figurine-tote bag in which the head part of the figurine portion is exposed and located exteriorly of the container part of the bag portion, thereby simulating the transport of the partially visible pet in the carrier;

said entire figurine portion being foldable and collapsible to a second compact state, and being stuffable in the second compact state in said one direction through the common opening into the interior bag cavity to stuff the same and convert the toy to a stuffed tote bag, thereby simulating the carrier itself;

said bag portion being foldable and collapsible to a third compact state, and being stuffable in the third compact state in a direction opposite to said one direction through the common opening into the interior figurine cavity to stuff the same and convert the toy to a stuffed figurine, thereby simulating the pet itself; and a double-pull zipper on the common wall for opening the common opening from either side of the common wall, and for at least partially closing the common opening after one of the torso, arm and leg parts in the first compact state, the entire figurine portion in the second compact state, and the bag portion in the third compact state has been stuffed into a respective one of the bag and figurine cavities, whereby the toy is easily converted among a combination figurine-tote bag configuration, a tote bag configuration and a figurine configuration to increase the overall play value of the toy.

* * * * *